US005657557A

United States Patent [19]

Hull et al.

[11] Patent Number: 5,657,557

[45] Date of Patent: Aug. 19, 1997

[54] FASTENER WHICH IS ATTACHABLE TO A SHOELACE

[76] Inventors: Harold L. Hull, 401 Canyon Way #43, Sparks, Nev. 89434; Dan E. Harmer, 864 E. Second St., Reno, Nev. 89502; James W. Dobney, 447 Ridgeway, Ontario, Oreg. 97914

[21] Appl. No.: 673,514

[22] Filed: Jul. 1, 1996

[51] Int. Cl.[6] ..... A43B 23/28; A43C 11/00

[52] U.S. Cl. ..... 36/58.5; 36/50.1

[58] Field of Search ..... 36/1, 132, 136, 36/58.5, 58.6, 50.1; 24/3.3, 298, 800

[56] References Cited

U.S. PATENT DOCUMENTS

| | | | |
|---|---|---|---|
| 1,089,073 | 3/1914 | Palmer | 36/58.5 |
| 1,516,465 | 11/1924 | Dennison et al. | 36/58.5 |
| 3,456,366 | 7/1969 | Boeing | 36/58.5 |
| 3,486,250 | 12/1969 | Purtle | 36/72 |
| 4,458,373 | 7/1984 | Maslou | 12/142 LC |
| 4,624,060 | 11/1986 | Maxwell | 36/58.5 X |
| 4,949,437 | 8/1990 | Anderson | 24/712.2 |
| 5,316,189 | 5/1994 | Galerous et al. | 223/113 |
| 5,319,869 | 6/1994 | McDonald et al. | 36/114 |
| 5,335,400 | 8/1994 | Sales | 24/712.5 |
| 5,349,764 | 9/1994 | Posner | 36/50.1 |
| 5,402,589 | 4/1995 | Lubrani et al. | 36/50.1 |

FOREIGN PATENT DOCUMENTS

| | | | |
|---|---|---|---|
| 5683 | 3/1901 | United Kingdom | 36/58.5 |

*Primary Examiner*—B. Dayoan

[57] ABSTRACT

A fastener which includes a flexible counter strap having a hook on each end with the hooks each being removably attachable to loop portions which are formed in the shoelace when the lace has been tied into a bow and which is further secured by a locking, slidable member.

6 Claims, 2 Drawing Sheets

FASTENER WHICH IS ATTACHABLE TO A SHOELACE

FIELD OF THE INVENTION

The present invention relates to fasteners which are used to keep a shoelace from accidentally becoming untied, but more particularly relates to a fastener which includes a flexible counter strap having a hook on each end with the hooks being removably attachable to loop portions which are formed in the shoelace when the lace has been tied into a bow and which is further secured by a locking, slidable member.

BACKGROUND OF THE INVENTION

It is well known by anyone who has worn a lace up type shoe that the lace will accidently become untied while being worn and this is not only very bothersome but this can be quite dangerous as well, due to tripping over the untied shoe lace, etc. Furthermore, in the case of athletes or the like, this can be most unfortunate if such occurs during a race and this can even make the difference between winning and losing.

It is to be noted that this is a great problem and one which many inventors have tried to resolve, as the prior art is very crowded, however, nowhere did the applicants find a successful solution, such as taught by the present invention.

The previous attempts to solve the noted problem have not been successful and each have inherent disadvantages and drawbacks which the present invention addresses and eliminates, for example, U.S. Pat. Nos. 5,402,589, 5,335,400, 5,316,189 and 4,949,437 each attempt to resolve the problem by providing a fastener of some type which is removably attached to the knot tied in the shoelace.

Unfortunately, each of these devices include complicated steps which are not easily performed, even by an adult and these devices are especially complicated for children to use. Furthermore, each of these devices are positioned and attached either to the tongue section of the shoe and/or to the knotted portion of the shoelace and each device when so attached is very bulky and each are likely to interfere with the cuff portion of a pant leg when worn with a pair of pants and this is not only bothersome but can also cause unnecessary tears in the cuff portion.

Also, each of the devices must be attached to the shoe during the tieing process, as none are attachable to the shoe after the lace has been tied into a bow, such as is the present invention.

SUMMARY OF THE INVENTION

The present invention is substantially a fastener which may be removably attached to substantially any type of laced shoe, sandal, boot, etc., after the shoelace has been tied into a typical bow, with the fastener being substantially a flexible counter strap which is folded over upon itself with the free ends being slidably, threadably engaged within an adjustable locking member, and each of the free ends having a hook with each hook being removably attached to the loop portions formed by the bow.

It is therefore an object of the present invention to provide a fastener which is removably attachable to substantially any type of lace-up shoe, sandal, boot, etc., with the shoe being substantially of any size.

It is another object of the present invention to provide a fastener which is worn about the counter portion, respectively, of a shoe.

Also, another object of the present invention is to provide a fastener which is adjustably, removably attached to a shoe of choice after the shoe has been positioned on the foot and the shoelace has been tied into a typical bow.

Still a further object of the present invention is to provide a fastener which does not interfere with the cuff portion of a pant leg and the fastener does not protrude from above the top portion of the shoe, such as taught within the known prior art.

Yet another object of the present invention is to provide a fastener which may be easily used by adults and young children as well.

Also, another object of the present invention is to provide a fastener which can be attached to substantially any shoe and which will not allow for the shoelace to become untied until the user removes the fastener therefrom.

Yet another object of the present invention is to provide a fastener which includes very few parts, namely, a flexible strap having a hook on each of its ends and a slidable locking member.

Still another object of the present invention is to provide a fastener which is most economical to manufacture and is easily marketable.

Yet another object of the present invention is to provide a fastener which heretofore has not been seen nor taught within the prior art and one which addresses each of the known problems and overcomes all of the inherent disadvantages known in the prior art.

Still another object of the present invention is to provide a fastener which includes a unique method of use.

Other objects and advantages will be seen when taken into consideration with the following specification and drawings.

DETAILED DESCRIPTION OF THE DRAWINGS

Figure 1:
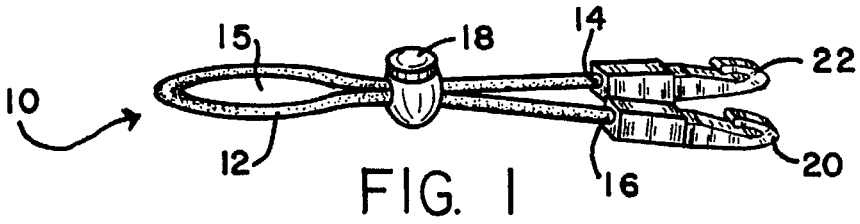
FIG. 1 is substantially a perspective view of the present invention.

Referring now in detail to the drawings wherein like characters refer to like elements throughout the various drawings, wherein arrow (10) of FIG. 1 represents an overview of the present invention, which is substantially a fastener comprising; a flexible strap (12) which is folded over upon itself (thus forming a loop 15) having a first end 14) and a second end (16), with the first end (14) and the second end (16) each being threadably slidably engaged into and through a slidable adjustable locking member (18), with the first end (14) being fixedly attached (such as by glue, or the like) to a first hook member (20) and the second end being fixedly attached (such as by glue, or the like) to a second hook member (22).

It is to be noted that fastener (10) may be used for adjustably fastening substantially any two objects of choice together, and is thus considered by the applicants to be substantially a multipurpose fastener having many uses, to numerous to mention. For example, fastener (10) if so desired, may be used as an adjustable, removably attached clothes line, with the first hook member (20) being removably hooked to a first object of choice, such as a tree, (not shown), with the second hook member (22) being removably hooked to a second object of choice, such as a second tree, (not shown), and the locking member (18) when slidably adjusted causes the strap (12) to become taut, thus eliminating any slack, and the locking member (18) may then been locked into place. Again, this is only exemplary of one possible use for fastener (10) and therefore the present invention is not to be limited thereto. However, it is to be further noted that the preferred use and embodiment is a fastener (10) which is used to removably, adjustably retain a shoelace in a tied position, as later described.

Strap (12) is substantially made from any suitable flexible material of choice, such as elastic, and is of any suitable length of engineering choice and may be produced in numerous colors of choice. Also, the slidable adjustable locking member (18) may be substantially any suitable slidable member of engineering choice, and each of the hook members (20) & (22) may be any suitable hook member of engineering choice. However, the present invention may be easily manufactured from pre-existing parts, if so desired, namely, strap (12) is produced in varying lengths and in different colors by "Hope Webbing Co.", known as a shock chord, and the slidable locking member (18) is also produced in numerous sizes and in various colors of choice by "Duraflex", known as an orb lock, and each of the hook members (20) & (22), are produced in various sizes and in various colors of choice, also by "Duraflex". Therefore, it is contended by the applicants that this invention is substantially a new use for an old idea, as each of the parts exist individually, however, nowhere in the prior art do they teach the unique combination of parts, as herein taught, nor do they teach a new use for such a unique combination which provides most unexpected results and inherent advantages, as herein taught.

Figure 2:
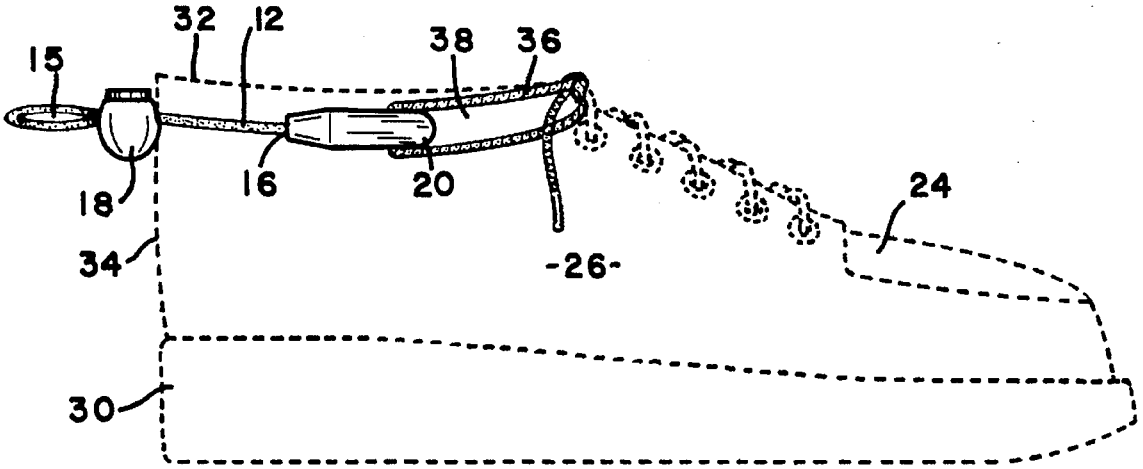
FIG. 2 is substantially a plan view showing the present invention when attached to a shoe, with the shoe being shown in phantom.
Figure 3:
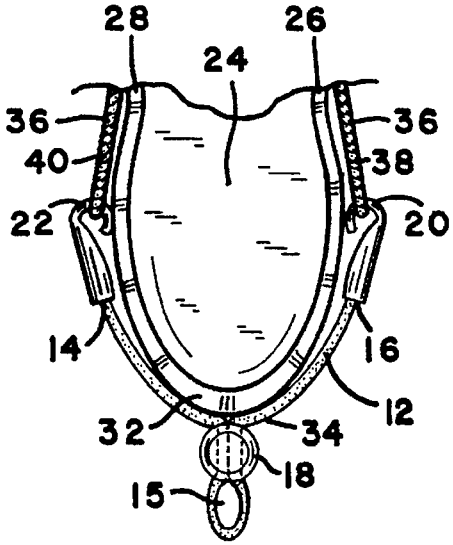
FIG. 3 is substantially a partial top view the shoe of FIG. 2.
Figure 4:
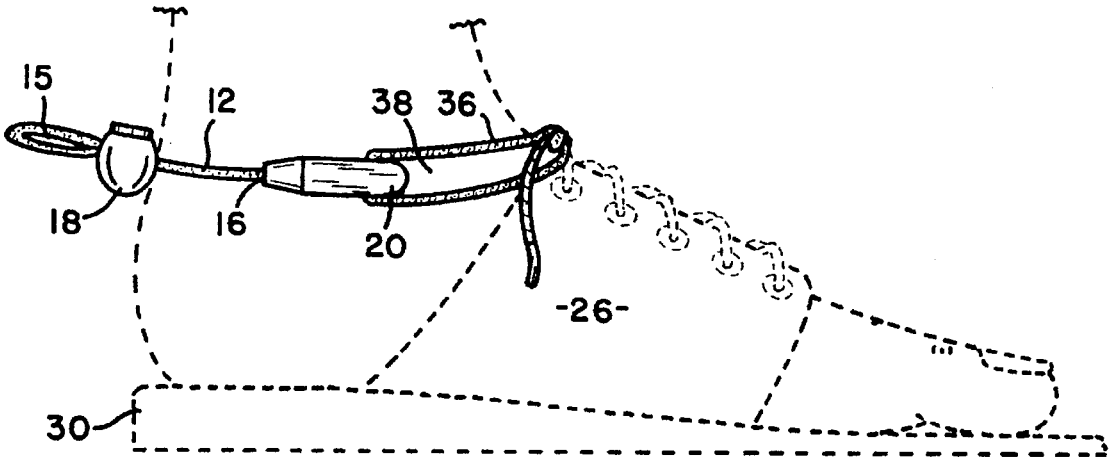
FIG. 4 is a view of the fastener as used with a sandal.
Figure 5:
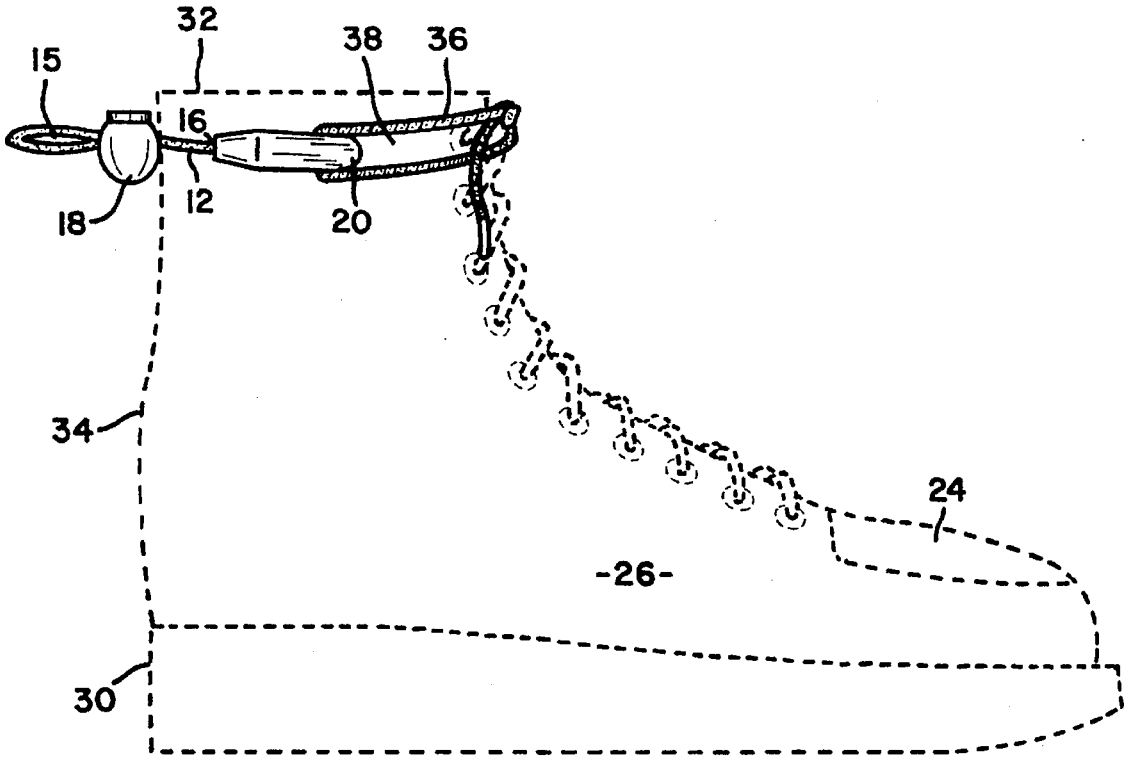
FIG. 5 is a view of the fastener as used with a boot.

Referring now to FIGS. 2 & 3, wherein we teach the preferred use and embodiment for fastener (10). As shown in FIG. 2, (24) is exemplary of some type of footwear, (such as a sandal, boot, shoe, or the like FIGS. 4, 5, and 3, respectively) which includes at least a first side (26), a second opposing side (28), (see FIGS. 3), a heel (30), (see FIG. 2), a top rim (32), a counter portion (34), and a shoelace (36). Counter portion (34) extends substantially vertically from the heel (30) to the rim (32) and has an outside circumference which is measured from the first side (26), around the counter portion (34), to the second side (28) thereof. Referring now to the plan view of FIG. 2, wherein we show a laced shoelace (36), (which is substantially any suitable shoelace of engineering choice) which is tied into a bow, thus forming a first loop (38) which is substantially positioned on the first side (26) and a second loop (40) which is substantially positioned on the second side (28), respectively and it is to be noted that the fastener (10) of the preferred embodiment includes strap (12) having a length greater than the afore mentioned circumference. Therefore, it will now be seen that when the strap (12) is positioned around the noted outside circumference, and the first hook (20) is removably attached to the first loop (38) and the second hook (22) is removably attached to the second loop (40), and then the slidable member (18) is adjusted to a location of choice and then locked in place, that the first and second loop (38) & (40), are each held in a secure manner and the bow will not become accidentally untied.

The following is exemplary of a method of use for the present invention wherein the fastener (10) is used to removably, adjustably attach any two objects of choice together, including the following steps of;

a. grasping fastener (10);

b. attaching the first hook member (20) to an object;

c. attaching the second hook member (22) to an object;

d. adjusting the locking member (18) in a slidable manner until the strap (12) becomes taut; and e. locking member (18) into place.

The following is a method of use for the present invention which teaches a fastener which cooperates with footwear and which is removably, adjustably attachable thereto, including the following steps of;

a. putting the footwear (24) on a users foot;

b. tieing a bow in the shoelace (36), thus forming the first and the second loop, (38 & 40);

c. placing the first loop (38) on the first side (26) of the footwear (24);

d. placing the second loop (40) on the second side (28) of the footwear (24);

e. grasping the fastener (10);

f. positioning the fastener (10) around the above mentioned circumference;

g. go attaching the first hook (20) to the first loop (38);

h. attaching the second hook (22) to the second loop (40);

i. adjusting the locking member (18) in a slidable manner until the strap (12) becomes taut; and j. locking the locking member in place.

It will now be seen that we have herein provided a unique fastener having many uses which heretofore has not been seen nor taught within the prior art.

It will also be seen that we have herein provided a fastener which is formed from only three components, namely, a strap, a slidable locking member and hooks, with the slidable member being the only moving part.

It will further be seen that we have herein provided a fastener which is economical to manufacture and market.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatuses.

Having described our invention, what we claim as new and wish to secure by a Letters Patent is:

1. Footwear having at least a first side; a second side; a heel; a top rim; a counter portion extending substantially vertically from said heel to said rim and an outside circumference measured from said first side and around said counter portion to said second side thereof; and a laced shoelace which is tied into a bow forming a first loop on said first side and a second loop on said second side, respectively, a fastener comprising; a flexible strap having a length greater than said circumference, said strap being folded over upon itself having a first end and a second end, said first end and said second end each being slidably threadably engaged into and through an adjustable slidable locking member, said first end being fixedly attached to a first hook member and said second end being fixedly attached to a second hook member, whereby;

said strap is positioned about said circumference and said first hook is removably attached to said first loop and said second hook is removably attached to said second loop and said slidable member is adjusted and locked, whereby;

said first and said second loop are each held in a secure manner and said bow will not become accidentally untied.

2. The footwear of claim 1 is a shoe.

3. The footwear of claim 1 is a sandal.

4. The footwear of claim 1 is a boot.

5. A fastener which is removably, adjustably, attachable to a first and a second loop of a shoelace which has been laced through a shoe and then tied into a bow which forms said first and said second loop and said first loop being positioned substantially on the first side of said shoe and said second loop being positioned substantially on the opposing second side of said shoe, and said fastener comprising; a flexible strap having a greater length than the outside circumference measured from said first side of said shoe extending around the counter portion of said shoe to said second side of said shoe, respectively, and said strap having a first and a second end, said strap being folded over upon itself thus forming a loop, with said first and said second end each being threadably slidably engaged into and through an adjustable locking member, said first end having a fixedly attached first hook member and said second end having a fixedly attached second hook member, whereby;

said strap is positionable about said circumference and said first hook member is removably attached to said first loop and said second hook member is removably attached to said second loop and said adjustable locking member is slidably adjusted until said strap becomes taut about said circumference and said locking member is locked into place;

whereby;

said first and second loop are each held in a secure manner and said bow will not become accidentally untied.

6. A method of use for a fastener which cooperates with footwear, said footwear having at least a first side; a second side; a heel; a top rim; a counter portion extending substantially vertically from said heel to said rim and an outside circumference measured from said first side which extends substantially around said counter portion to said second side thereof; and a laced shoelace which is tied into a bow forming a first loop on said first side and a second loop on said second side, respectively, said fastener comprising; a flexible strap having a length greater than said circumference, said strap being folded over upon itself having a first and a second end, said first and said second end each being slidably threadably engaged into and through an adjustable slidable locking member, and said first end having a first hook fixedly attached thereto and said second end having a second hook fixedly attached thereto, said method comprising the following steps of;

a. putting said footwear on a users foot;

b. tieing said bow;

c. placing said first loop on said first side;

d. placing said second loop on said second side;

e. grasping said fastener;

f. positioning said fastener about said circumference;

g. attaching said first hook to said first loop;

h. attaching said second hook to said second loop;

i. adjusting said locking member in a slidable manner until said strap becomes taut; and j. locking said locking member in place.

* * * * *